United States Patent [19]

Bürger et al.

[11] Patent Number: 4,806,074

[45] Date of Patent: Feb. 21, 1989

[54] HIGH-VACUUM PUMP HAVING A BELL-SHAPED ROTOR

[75] Inventors: Heinz-Dieter Bürger, Wertheim, Fed. Rep. of Germany; Claude Saulgeot, Veyrier du Lac, France

[73] Assignee: Alcatel Hochvakuumtechnik GmbH, Wertheim, Fed. Rep. of Germany

[21] Appl. No.: 154,563

[22] Filed: Feb. 10, 1988

[30] Foreign Application Priority Data

Feb. 24, 1987 [DE] Fed. Rep. of Germany ..... 3705912

[51] Int. Cl.[4] ..... F01D 1/36

[52] U.S. Cl. ..... 415/72; 415/90

[58] Field of Search ..... 415/71, 72, 90, 170 R, 415/170 B

[56] References Cited

U.S. PATENT DOCUMENTS

| | | | |
|---|---|---|---|
| 1,492,846 | 5/1924 | Holweck et al. | 415/90 |
| 2,730,297 | 1/1956 | van Dorsten et al. | 415/90 |
| 3,832,084 | 8/1974 | Maurice | 415/90 |
| 4,270,882 | 6/1981 | Luijten et al. | 415/90 X |

FOREIGN PATENT DOCUMENTS

| | | | |
|---|---|---|---|
| 2526164 | 12/1976 | Fed. Rep. of Germany | 415/90 |
| 2906826 | 9/1979 | Fed. Rep. of Germany | 415/170 B |
| 222288 | 7/1942 | Switzerland | 415/90 |

*Primary Examiner*—Robert E. Garrett
*Assistant Examiner*—Joseph M. Pitko
*Attorney, Agent, or Firm*—Sughrue, Mion, Zinn, Macpeak and Seas

[57] ABSTRACT

A molecular high-vacuum pump has a bell-shaped rotor 5 including a shaft supported by roller bearings 12, 13 disposed inside the bell rotor. The stator 1, 6 defines two converging pumping stages, one in cooperation with the inner cylindrical surface 10 of the rotor and the other in cooperation with the outer cylindrical surface 9 of the rotor. The suction inlet 3 is disposed in the apex area 4 of the bell rotor. The discharge outlet 11 of the pump is disposed in the vicinity of the lower rim of the bell, and both pumping stages transfer gases towards this rim. In this way, gases introduced through the inlet 3 into the pump cannot penetrate into the motor space 15 and damage the bearings of the pump.

3 Claims, 1 Drawing Sheet

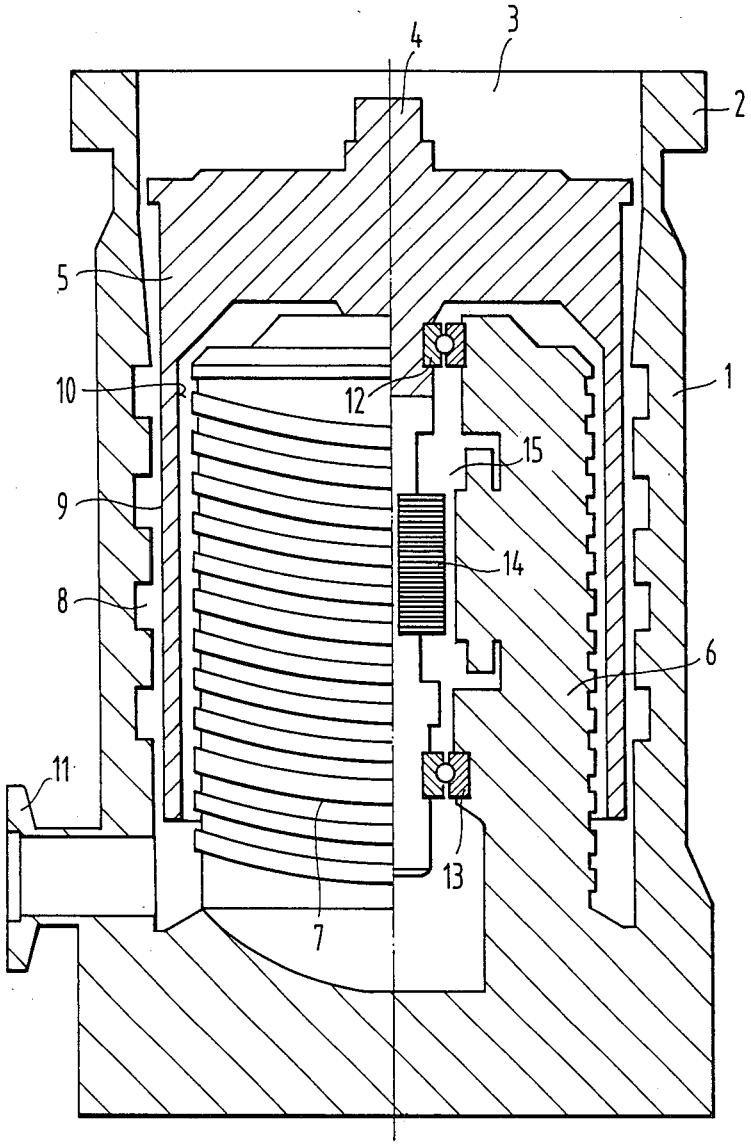
3
4
2
5
1
10
12
15
9
14
8
6
11
13
7

HIGH-VACUUM PUMP HAVING A BELL-SHAPED ROTOR

FIELD OF THE INVENTION

The invention refers to a high-vacuum pump having a bell-shaped rotor which is supported by rolling bearings located inside the rotor bell, and having a stator which defines molecular pumping stages in cooperation with the inner cylindrical surface of the rotor and with the outer cylindrical surface of the rotor, at least the first mentioned stage being of the Holweck type a suction inlet is provided at the apex of the bell-shaped rotor.

DESCRIPTION OF THE PRIOR ART

In a known molecular pump of this type, see German Offenlegungsschrift No. 25 26 164, the pumping stages at the inside and the outside of the bell-shaped rotor are operated in series. This means that, if the suction inlet is located at the apex of the bell-shaped rotor, the discharge outlet towards the mechanical vacuum pump must be associated to the central inner space of the stator. This signifies that the gases to be pumped propagate first along the outer rotor surface, and then they turn around the edge of the bell-shaped rotor and propagate in the opposite direction towards the central inner space of the bell. Since the motor and the bearings of the pump are located in this space, gases and vapours originating from the container to be evacuated are susceptible to damage the bearings and the motor elements, thus reducing the lifetime of the pump.

This problem can be overcome by providing a protective casing for the bearings and the motor and by reducing as far as possible the free passage between moving and stationary parts in this area. It is then possible to inject an inert gas, for example nitrogen, into the casing at such a pressure that a gas flow is established from said casing to the outlet, thus preventing gases from flowing in the opposite direction. This, however, increases the manufacturing and operating costs of the pump.

Another known molecular pump with a bell-shaped rotor and pumping stages in association as well with the inner as with the outer surface of the cylindrical bell-shaped rotor is shown in U.S. Pat. No. 2,730,297. In this known pump, the two stages are not functionally in series, but in parallel. In spite of this difference, the inner space of the bell containing the bearings is still in communication with the discharge outlet of the pump and is thus subjected to the detrimental effects of the pumped gases.

The main object of the invention is to propose a high vacuum pump having a bell-shaped rotor and pumping stages in association with both cylindrical surfaces of the rotor, in which neither the bearings nor the motor may get into contact with gases and vapours originating from an enclosure to be evacuated. Expensive means such as additional inert gas circuits should, however, be avoided.

SUMMARY OF THE INVENTION

This object is achieved by a high-vacuum pump comprising a bell-shaped rotor, the shaft of which is supported by rolling bearings located inside the rotor bell, and comprising a stator which constitutes pumping stages as well with the inner cylindrical surfaces of the rotor and with the outer cylindrical surfaces of the rotor, at least the first mentioned stage being of the Holweck type, a suction inlet being provided at the apex of the bell-shaped rotor, wherein the discharge outlet of the pump is disposed at the rim of the bell-shaped rotor, and said Holweck type stage is conceived to pump particles towards said rim and to produce a higher vacuum in the area including the rolling bearings than at the rim of the bell-shaped rotor.

In a preferred embodiment of the invention, a motor which drives the pump is disposed between two rolling bearings inside the bell-shaped rotor.

If both pumping stages are of the Holweck type, the depth and width of the grooves as well as the distance between stator and rotor are substantially greater in the pumping stage constituted between the outer surface of the rotor and the opposed stator surface than in the inner pumping stage.

The manner in which the invention may be put into practice will now be described by way of non-limiting example with reference to the accompanying drawings showing schematically a Holweck type high vacuum pump according to the invention.

DESCRIPTION OF THE PREFERRED EMBODIMENT

The pump as shown in the drawings is provided with a casing 1 which can be connected via a flange 2 to an enclosure to be evacuated. The suction inlet 3 is thus located inside this flange around the apex 4 of a bell-shaped rotor 5 which may be inserted into the casing 1. A tubular stator member 6 extends upwardly from the bottom of the casing and is provided with grooves 7 of a Holweck type pumping stage at its outer cylindrical surface. Similar grooves 8, but of larger size, are cut into the inner cylindrical surface of the casing 1 and cooperate with the outer cylindrical surface 9 of the rotor to constitute another Holweck type pumping stage. The inclination of the grooves 7 and of the grooves 8 is such that the pumping effect in both stages is directed downwards in the drawings. The gases to be pumped are present at the suction inlet 3 and are transferred downwards by the stator grooves 8 and the outer cylindrical surface 9 of the rotor. These gases leave the pump through a discharge outlet 11 disposed in the vicinity of the rim of the bell-shaped rotor 5. The rotor is supported by two rolling bearings 12 and 13 disposed inside the tubular stator 6. A motor 14 is located between the two bearings. The details of the motor with its coils, magnetic core end electrical supply are not shown as these items are of conventional nature.

Gases which might be present in the space 15 including the motor and the bearings are transferred towards the discharge outlet 11 by means of the Holweck type pumping stage constituted by the grooves 7 and the inner cylindrical surface 10 of the rotor. Any gases which might be detrimental to the motor and the bearings and which might be present at the suction inlet 3 are prevented from entering into the space 15, because in this case, they would be obliged to migrate through the grooves 7 against the pumping direction of this pumping stage. Thus, this stage acts as a dynamic seal which does not consume substantial pumping power. This dynamic seal is only conceived to produce a pressure difference between the space 15 and the outlet 11. Thus, the grooves 7 can be substantially less deep and can be located closer to each other than the corresponding grooves 8 on the other side. Such a dynamic seal can for example maintain a pressure difference of 5000 Pa and more.

The use of an inert gas for sweeping the space 15 is superfluous in the majority of cases, although a small quantity of inert gas may be injected into the space for improving the reliability of the protection against the penetration of gases into the space 15.

An important advantage of the pump according to the invention is that it is substantially insensitive to short-term pressure increases up to some 1000 Pa. Even a very short-term pressure increase to atmospheric pressure does not entail a complete destruction of the vacuum in the space 15.

The invention is not restricted to the preferred embodiment described above. In fact, it applies also to turbomolecular pumps, in which instead of or in addition to the grooves 8, a turbomolecular stage is provided as shown in the above-cited German Offenlegungsschrift.

I claim:

1. A high-vacuum pump, comprising: a downwardly depending rotor (5) including a rotor bell land an axial, downwardly extending shaft, an upwardly extending stator (1, 6) supporting the rotor via axially spaced roller bearings (12, 13) located inside the rotor bell between the stator and the shaft, said stator defining a first pumping stage (7, 10) with an inner cylindrical surface (10) of the rotor and a second pumping stage (8, 9) with an outer cylindrical surface (9) of the rotor, at least the first pumping stage being of the Holweck type, a suction inlet (3) provided at an apex (4) of the rotor bell, and a discharge outlet (11) disposed proximate a lower rim of the rotor bell, said Holweck type first pumping stage defining a blind bore terminating at a closed upper end of the rotor bell and being configured to pump particles towards said rim to produce a higher vacuum in an interior space (15) in which the roller bearings are disposed than at the rim of the rotor bell, and said first and second pumping stages converging at outlet ends thereof proximate the discharge outlet.

2. A high-vacuum pump according to claim 1, wherein a motor (14) driving the pump is disposed between the two roller bearings inside the rotor bell.

3. A high-vacuum pump according to claims 1 or 2, wherein both the first and second pumping stages are of the Holweck type, and the depth and width of grooves (8) as well as the distance between stator and rotor in the second pumping stage are greater than in the first pumping stage.

* * * * *